US005929540A

United States Patent [19]

Hatcher

[11] Patent Number: 5,929,540

[45] Date of Patent: Jul. 27, 1999

[54] SWITCHING CIRCUIT FOR SWITCHING THE MODE OF OPERATION OF A SUBTERRANEAN PROBE AND METHOD OF SWITCHING

[76] Inventor: Wayne B. Hatcher, P.O. Box 305, Harvey, La. 70059

[21] Appl. No.: 08/868,239

[22] Filed: Jun. 3, 1997

[51] Int. Cl.[6] ..... H01N 47/00

[52] U.S. Cl. ..... 307/125; 307/112; 361/191; 361/210; 361/156; 33/304

[58] Field of Search ..... 307/112, 173, 307/116, 125, 130, 147, 326, 328; 361/187, 191, 204, 210, 144, 145, 146, 154, 156, 160; 33/302, 312, 313, 304

[56] References Cited

U.S. PATENT DOCUMENTS 4,361,192 11/1982 Trowsdale ..... 175/45
4,527,216 7/1985 Stammely ..... 361/156
5,230,387 7/1993 Waters et al. ..... 175/45
5,508,878 4/1996 Pecore ..... 361/195

*Primary Examiner*—Jeffrey Gaffin
*Assistant Examiner*—Jonathan S. Kaplan
*Attorney, Agent, or Firm*—George A. Bode; Lisa D. Charouel; Bode & Associates

[57] ABSTRACT

A switching circuit for use in a subterranean probe for switching between to two modes of operation used to perform a survey of a well borehole. The switching circuit comprises a first voltage bias network which is biased to a predetermined overvoltage criterion; a second voltage bias network which is biased to a predetermined negative voltage criterion; a switch; and a negative voltage blocking diode for blocking the predetermined negative voltage criterion for allowing the first voltage bias network to fully realize the negative voltage criterion.

15 Claims, 1 Drawing Sheet

SWITCHING CIRCUIT FOR SWITCHING THE MODE OF OPERATION OF A SUBTERRANEAN PROBE AND METHOD OF SWITCHING

BACKGROUND OF THE INVENTION

1. Field of the Invention

The present invention relates to a switching circuit integrated in a subterranean probe and, more particularly, to a switching circuit integrated in a subterranean probe for switching power propagated on a single wireline electrical conductor cable between two paths wherein each path of the two paths has coupled thereto at least a first probing means. More specifically, the present invention relates to a subterranean probe for performing a survey of a well borehole wherein such subterranean probe having said switching circuit integrated therein is switched between a surveying mode of operation and a location determination mode of operation for enhancing the validity of a survey of a well borehole by eliminating the measuring head error and the wireline stretch error. The present invention also relates to a method of switching the modes of operation of the subterranean probe.

2. General Background

A well borehole has a predetermined depth and an angle of inclination. For exemplary purposes, such depth is 20,000 feet and such angle of inclination is 45°. The length of the well borehole is surveyed with a surveying probing means such as, without limitation, a rate gyro device. The rate gyro device, coupled to a wireline electrical conductor cable, is lowered into the well borehole to determine the azimuth of the well borehole at incremental positions along its length. The measurements by the rate gyro device must be correlated to the incremental positions of measurement. Therefore, prior to lowering the gyro rate device, a location determination probing means, such as without limitation, at least a gamma ray device, is lowered into the well borehole via a wireline conductor cable to calibrate the counters used to measure the length of the wireline as the gyro rate device is lowered to a predetermined depth in of the well borehole.

The gamma ray device uses known gamma ray charts in combination with sand, shale or collars charts to calibrate such counters, as is known in the art. Additionally, radio active markers could be used.

This process of surveying a well bore hole requires several hours to lower the gamma ray device to the depth desired for measuring the well borehole wherein such measurement patterns are correlated with the above identified charts to calibrate the counters. For example, to lower a gamma ray device 10,000 feet takes approximately 5 hours. After the calibration of the counters is complete, the gamma ray device is raised and replaced with the gyro rate device. Thereafter, the gyro rate device is lowered to the predetermined depth. Such predetermined depth may be different from the desired depth for the gamma ray device. The time to lower the gyro rate device is now 5 or more hours depending on the predetermined depth for the gyro rate device. As can be appreciated, integrating in the subterranean probe the location determination mode and the surveying mode and switching the subterranean probe between the two modes, at least 50% savings in rig time and man hours can be had.

This known method of surveying, using a gyro rate device and a gamma ray device, gives rise to errors in measurement and compromises the validity of the survey. Such errors in measurement are known as the measuring head error and the wireline stretch error. Such errors are the result of several factors. Such factors comprise, without limitation, (1) weight differentials between the gyro rate device and the gamma ray device since the counters were calibrated in relation to the weight of the gamma ray device; and (2) surface residue on the wireline conductor cable which results from the initial lowering into the well borehole. For example, if the surface of the wireline cable was dry when the calibration was performed, the wireline cable may become muddy, wet and/or exposed of a slippery polymer. Therefore, as the wireline cable is un-spooled to lower the gyro rate device in the well borehole, errors occur with respect to the measuring head coupled to the calibrated counters used to measure the depth of the gyro rate device. As can be appreciated, the measuring head error and wireline stretch error are eliminated when the surveying device and the location determination device are integrated into a single subterranean probe.

While various multiconductor wireline cables are readily available for delivering power to a plurality of probing means, the cost of the multiconductor wireline cable is at least twice the cost of a single conductor wireline cable. Since the wireline cable is tens of thousands of feet long, significant savings is had using a single wireline electrical conductor cable. Moreover, the time to un-spool (lower) and spool (raise) a single wireline electrical conductor cable is significantly less than the time to un-spool and spool a multiconductor wireline cable.

As can be seen, there is a continuing need for a switching circuit integrated in a subterranean probe for switching power propagated on a single wireline electrical conductor cable between two paths wherein each path of the two paths has coupled thereto at least a first probing means. Furthermore, there is a need for a subterranean probe for performing a survey of a well borehole wherein such subterranean probe having said switching circuit integrated therein is switched between a surveying mode of operation and a location determination mode of operation for enhancing the validity of a survey of a well borehole by eliminating the measuring head error and the wireline stretch error.

SUMMARY OF THE PRESENT INVENTION

The preferred embodiment of the switching circuit of the present invention solves the aforementioned problems in a straight forward and simple manner. What is provided is a switching circuit integrated in a subterranean probe for switching power propagated on a single wireline electrical conductor cable between two paths wherein each of the two paths has coupled thereto at least a first probing means. Also provided is a subterranean probe which has integrated therein two complementary modes of operation and wherein such modes of operation may be automatically switched therebetween. Such subterranean probe performs a survey of a well borehole wherein such subterranean probe having said switching circuit integrated therein is switched between a surveying mode of operation and a location determination mode of operation for enhancing the validity of a survey of a well borehole by eliminating the measuring head error and the wireline stretch error. The present invention also provides a method of switching the modes of operation of the subterranean probe.

In view of the above, it is an object of the present invention to provide a subterranean probe having integrated therein a surveying probing means and a location determination probing means which are separated by a predetermined distance wherein the measuring head error and the wireline stretch error are eliminated. Henceforth, the validity of the survey of a well borehole is enhanced.

Another object of the present invention is to provide a first voltage bias network biased to a negative voltage criterion for controlling a switching means to switch power from a second path to a first path wherein said first voltage bias network cooperates with a means for blocking said negative voltage criterion and wherein said blocking means allows said first voltage bias network to fully realize said negative voltage criterion in order to control said switching means.

It is a further object of the present invention to provide such a subterranean probe which uses a single electrical wireline conductor for delivering power to two paths wherein each path of the two paths has a plurality of cascaded probing means coupled thereto.

It is still a further object of the present invention to provide a subterranean probe which significantly reduces the surveying time of a well borehole.

It is still a further object of the present invention to provide a method of switching the modes of operation of a subterranean probe based on a predetermined overvoltage condition and a predetermined negative voltage condition.

In view of the above objects, it is a feature of the present invention to provide a subterranean probe which is simple to use.

Another feature of the present invention is to provide a subterranean probe which is capable of integrating a plurality of probing means and which uses a single electrical wireline conductor cable to deliver power to the plurality of probing means wherein a single electrical wireline conductor cable is significantly cheaper than a multiconductor cable.

A further feature of the present invention is to provide a subterranean probe which is lowered down a well borehole more quickly with the use of a single electrical wireline conductor.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 2:
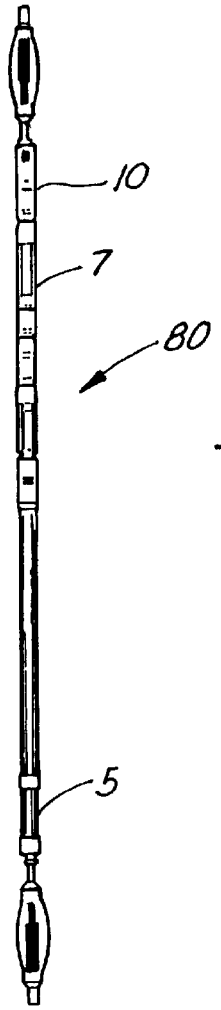
Figure 1:
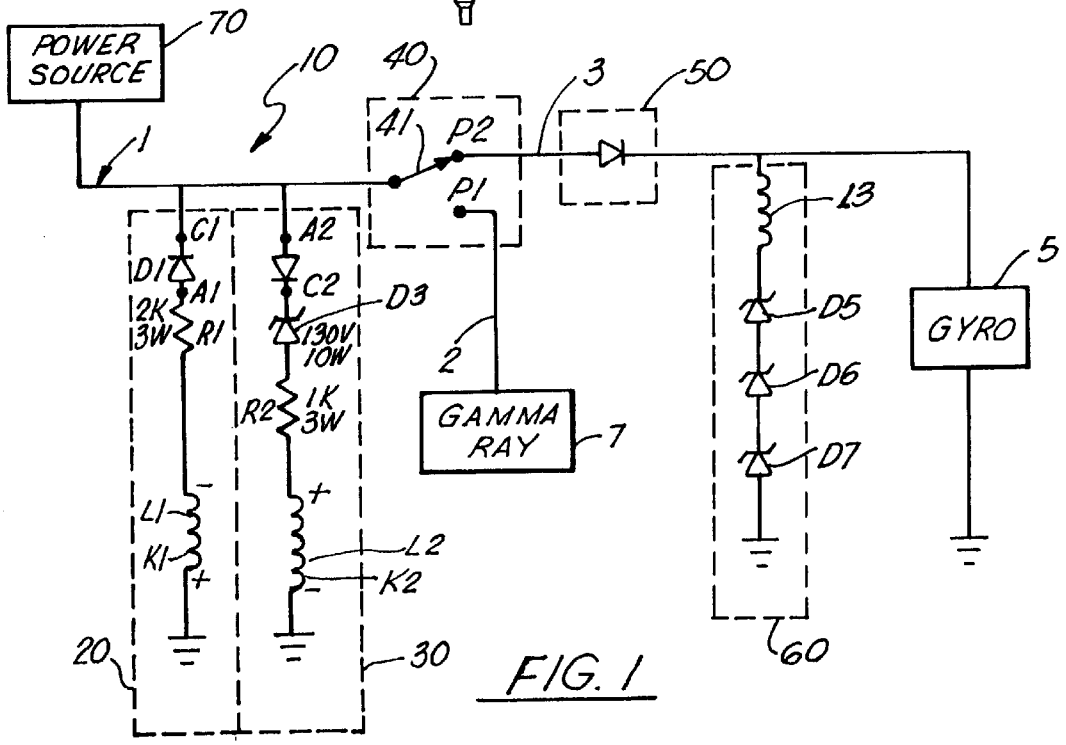
FIG. 1 illustrates the schematic diagram of the switching circuit of the preferred embodiment of the present invention; and, FIG. 2 illustrates a subterranean probe of the present invention.

Referring now to the drawings, and in particular FIGS. 1 and 2, the switching circuit of the present invention is designated generally by the numeral 10. In the preferred embodiment, subterranean probe 80 has integrated therein gamma ray device 7, gyro rate device 5 and switching circuit 10 for switching between the operations of gamma ray device 7 and the operations of gyro rate device 5 for performing a survey of a well borehole. Gyro rate device 5 and gamma ray device 7 are readily available by several manufactures. The actual operations of gyro rate device 5 and gamma ray device 7 are of limited importance to the present invention.

Gyro rate device 5 is spaced from gamma ray device 7 by a predetermined distance. While performing the survey, subterranean probe 80 is incrementally pulled through the well borehole until the subterranean probe reaches the earth's surface wherein, at each increment, subterranean probe 80 surveys the well borehole via the gyro rate device.

Initially, an operator controls switching circuit 10 to ensure switching circuit 10 couples DC power to path 2 for powering gamma ray device 7 wherein gamma ray device 7 determines the position of subterranean probe 80 for calibrating the counters coupled to the measuring head. Since there is a fixed predetermined distance between gamma ray device 7 and gyro rate device 5, the exact positions of the measurements taken by gyro rate device 5 can be had. Henceforth, the validity of the survey is not compromised and the measuring head error and the wireline stretch error are not factors of concern. After the counters are calibrated, the operator controls switching circuit 10 to switch to path 3 for delivering DC power to gyro rate device 5. Thereafter, gyro rate device 5 surveys the well borehole at increments along the well borehole. Unless desired or to re-calibrate the counters of the wireline, the switching circuit 10 only needs to remain switched to deliver DC power to path 3.

Subterranean probe 80 is coupled to power supply means 70 located on the earth's surface wherein power supply means 70 delivers power via a single wireline electrical conductor cable. Typically, gyro rate device 5 is coupled to a computing system (not shown) which receives and interprets the measurements by gyro rate device 5. Additionally, gamma ray device 7 is coupled to a computing system (not shown) which receives and interprets the measurements by gamma ray device 7. Since, the known gyro rate devices 5 and gamma ray devices 7 are independent, their computing systems are independent. Nevertheless, since subterranean probe 80 integrates the gamma ray device and gyro rate device into a single probe, a single computing system (not shown) could be easily substituted for the two independent computing systems (not shown).

In the exemplary embodiment, switching circuit 10 integrated in subterranean probe 80, of the present invention, switches between rate gyro device 5 used to determine the azimuth of a well bore and gamma ray device 7 used to determine the location of rate gyro device 5. Nevertheless, switching circuit 10 may be used to switch the mode of operation of a subterranean probe which integrates two other modes of operation.

Moreover, switching circuit 10 integrated in subterranean probe 80 is capable of delivering power via path 2 to a plurality of cascaded probing means such as, without limitation, a gamma ray device, collar locator and a neutron log device. The gamma ray device, collar locator and neutron log device are capable of working simultaneously because their data streams are distinctively different. Such distinctively different data streams are superimposed onto the downstream DC voltages and carried upstream to the computing systems on the earth's surface without interference. Likewise, switching circuit 10 integrated in subterranean probe 80 is capable of delivering power via path 3 to a plurality of cascaded probing means. Such cascaded probing means coupled to path 3 should have distinctively different data such that their data may be superimposed onto the DC voltages and carried upstream without interference.

Switching circuit 10 is generally comprised of first voltage bias network 20, second voltage bias network 30, switching means 40, and voltage blocking means 50.

First voltage bias network 20 serves to receive a predetermined negative voltage wherein said predetermined negative voltage switches subterranean probe 80 from a second mode of operation to a first mode of operation. In the preferred embodiment, subterranean probe 80 is switched from the surveying mode of operation performed by gyro rate device 5 to the location determination mode of operation performed by gamma ray device 7. Typically, the gamma ray device 7 has coupled thereto at least a collar locator device (not shown). Therefore, the location determination mode of operation includes the operation of the collar locator device.

First voltage bias network 20 comprises diode D1, resistor R1 and inductive means L1, each of which are coupled in series. The cathode C1 of diode D1 is coupled to input path 1, a single wireline electrical conductor cable. The anode A1 of diode D1 is coupled to one terminal of resistor R1. In the preferred embodiment, resistor R1 is a 2K Ohm/3 Watt resistor. The other terminal of resistor R1 couples to the negative side of inductive means L1 wherein inductive means L1 functions as a first inductance relay means to switch latching means 41 from position P2 to position P1 when first voltage bias network 20 receives said predetermined negative voltage and magnetizes inductive means L1. The positive side of inductive means L1 is coupled to ground.

Second voltage bias network 30 serves to receive a predetermined overvoltage wherein said second predetermined overvoltage switches subterranean probe 80 from said first mode to said second mode. Second voltage bias network 30 comprises diode D2, diode D3, resistor R2 and inductive means L2. The anode A2 of diode D2 is coupled to input path 1. The cathode C1 of diode D2 is coupled to diode D3, a zener diode. The output side of diode D3 is coupled to one terminal of resistor R2. In the preferred embodiment, resistor R2 is a 1K Ohm/3 Watt resistor. The other terminal of resistor R2 couples to the positive side of inductive means L2 wherein inductive means L2 functions as a second inductance relay means to switch latching means 41 from position P1 to position P2 when second voltage bias network 30 receives said predetermined overvoltage and magnetizes inductive means L2. The negative side of inductive means L2 is coupled to ground.

Switching means 40 comprises latching means 41 which is switched between position P1 and position P2 based upon said predetermined overvoltage and said predetermined negative voltage for switching the mode of operation of subterranean probe 80. When latching means 41 is in position P1 (the initial position), power from input path 1 is supplied to path 2 for delivering positive DC voltages within the operational range required by gamma ray device 7. Latching means 41 is maintained in position P1 until the inductance relay urges latching means 41 to switch to position P2. When latching means 41 is in position P2, power from input path 1 is supplied to path 3 for delivering positive DC voltages within the operational range required by gyro rate device 5. Latching means 41 is maintained in position P2 until the inductance relay urges latching means 41 to switch to position P1. Even if power is removed from input path 1, latching means 41 remains in its last position, i.e., position P1 or position P2.

The positive DC voltages supplied to path 2 are capable of powering a plurality of cascaded probing means coupled to path 2. Additionally, the positive DC voltages supplied to path 3 are capable of powering a plurality of cascaded probing means coupled to path 3.

Voltage blocking means 50 is coupled to input path 3 between position P2 and voltage regulator network 60 wherein voltage regular network 60 serves as a power regulator for gyro rate device 5. Voltage blocking means 50 serves to block said predetermined negative voltage so that such predetermined negative voltage can be fully realized by first voltage bias network 20. In the preferred embodiment, voltage blocking means 50 is a negative voltage blocking diode.

Alternatively, voltage blocking means 50 may be integrated in a probing means coupled to path 3 provided voltage blocking means 50 serves to block said predetermined negative voltage for allowing switching means 40 to switch power delivered on input path 1 (a single electrical wireline conductor cable) to path 2 (an alternate path) for operating a single probing means or a plurality of cascaded probing means coupled to path 2 (an alternate path).

While the preferred embodiment provides for voltage blocking means 50 in path 3, alternatively, voltage blocking means 50 may be placed in path 2 or integrated in a probing means in path 2. If voltage blocking means 50 is coupled anywhere in path 2, then said first inductance relay means would switch latching means 41 from position P1 to position P2 and said second inductance relay means would switch latching means 41 from position P2 to position P1.

Voltage regulator network 60 comprises inductor L3 coupled in series with a plurality of series coupled zener diodes D5, D6, and D7. Voltage regulator network 60 is readily available and is usually integrated into gyro device 5 wherein voltage regulator network 60 serves to protect gyro device 5 from voltage variations, overvoltage and undervoltage surges. voltage regulator network 60 serves to regulate positive and negative voltages coupled to path 3 before such voltages are received by gyro rate device 5.

As can be appreciated, the regulating properties of voltage regulator network 60 would prevent said is predetermined negative voltage from collecting at inductive means L1. Henceforth, subterranean probe 80 would be prevented from automatically switching between the two modes of operation. Therefore, using voltage blocking means 50 which serves to block said predetermined negative voltage, switching means 40 can be automatically switched between said first and second modes of operation to perform the survey.

The following description will be referring to the method of switching the power to subterranean probe 80 via input path 1 (a single electrical wireline conductor cable) to a first path (path 2) or a second path (path 3) wherein each path has coupled thereto at least one probing means. For illustrative purposes, the method described will be in relation to perform a survey of a well borehole since such survey requires switching between a location determination probing means and a surveying probing means.

The method of switching initially requires latching means 41 to be in position P1 for operating subterranean probe 80 in the location determination mode performed by gamma ray device 7, said location determination probing means. In order to initially place latching means 41 in position P1, the operator controls power supply means 70 to supply a negative 85-DC Volts for a predetermined time interval T2. Said negative 85-DC Volts is said predetermined negative voltage and, in the preferred embodiment, said 85-DC Volts is momentarily delivered. Voltage blocking means 50 blocks said predetermined negative voltage from continuing on path 3. Therefore, said predetermined negative voltage is prevented from being absorbed by voltage regulator network 60. The blocked predetermined negative voltage is received by first voltage bias network 20. Diode D1 is turned on and passes therethrough said predetermined negative voltage to inductive means L1. Inductive means L1 switches latching means 41 from position P2 back to position P1.

Thereafter, power supply means 70 continuously delivers positive DC voltages within the operating range of gamma ray device 7 until the location determination is determined.

The operator then controls power supply means 70 to deliver at least 150-DC Volts of power for a predetermined time interval T1. The at least 150-DC Volts is the predetermined overvoltage whereby the at least 150-DC Volts is above the normal operating range of gamma ray device 7. Conventional gamma ray devices require 120-DC Volts. In the preferred embodiment, said at least 150-DC Volts is momentarily delivered.

Second voltage bias network 20 receives the at least 150-DC Volts propagated along input path 1. Diode D2 is turned on to pass therethrough the at least 150-DC Volts to inductive means L2 wherein inductive means L2 serves to switch latching means 41 to position P2. Any residual overvoltage passed from input path 1 to path 3 is absorbed by voltage regulator network 60.

Thereafter, the operator controls power supply means 70 to deliver positive DC voltages in the operating range of gyro rate device 5. Gyro rate device 5 performs the surveying mode of operation of subterranean probe 80 wherein gyro rate device 5 determines the azimuth of the well borehole.

Since latching means 41 remains in position P2 unless said predetermined negative voltage is propagated down path 1, the initial placing of latching means 41 in position P1 via said predetermined negative voltage criterion may be performed after the surveying mode of operation is complete. Nevertheless, the initial placing of latching means 41 in position P1 via said predetermined negative voltage criterion must be performed prior to power supply means 70 delivering the positive DC voltages to gamma ray device 7.

The subterranean probe 80 is incrementally raised along the well borehole. At each such increment, subterranean probe 80 surveys in the surveying mode the well borehole wherein subterranean probe 80 determines the azimuth at such increment.

While the exemplary embodiment switches based on at least 150-DC Volts and a negative 85-DC Volts, any predetermined overvoltage and negative voltage criteria may be substituted with modifications to first voltage bias network 20 and second voltage bias network 30.

As can be seen, the method of switching the power delivered to subterranean probe 80 via input path 1 (a single electrical wireline conductor cable) to a first path (path 2) or a second path (path 3), wherein each path has coupled thereto at least one probing means, switches based on a predetermined overvoltage criterion and a predetermined negative voltage criterion. Depending on the probing means coupled to said first path or said second path, the operator can control switching means 40, as desired, to switch between at least one probing means coupled to said first path and at least one probing means coupled to said second path.

Switching circuit 10 has application in a subterranean probe using a multiconductor wireline cable wherein a single conductor, of the multiconductor wireline cable, need only be used to switch between at least two probing means. Additionally, switching circuit 10 may be used to provide redundancy in subterranean probe 80 wherein the at least one probing means coupled to path 2 is the same as the at least one probing means coupled to path 3.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A switching circuit for use in a subterranean probe comprising:

(a) means for switching power on an input path to a first path or a second path wherein said first path and said second path each have coupled thereto at least one means for probing;

(b) a first voltage bias network directly coupled to said input path and biased to a negative voltage criterion for controlling said switching means to switch power from said second path to said first path;

(c) a second voltage bias network directly coupled to said input path and biased to an overvoltage criterion for controlling said switching means to switch power from said first path to said second path; and, (d) a means for blocking said negative voltage criterion for allowing said first voltage bias network to fully realize said negative voltage criterion coupled directly to said second path.

2. The switching circuit of claim 1, wherein said first voltage bias network comprises:

a diode coupled to said input path;

a resistor coupled in series with said diode; and, an inductive means, coupled in series with said resistor, for inductively relaying to switch said switching means.

3. The switching circuit of claim 2, wherein said blocking means prevents said negative voltage criterion from being absorbed by a voltage regulator network.

4. The switching circuit of claim 1, wherein said second voltage bias network comprises:

a diode coupled to said input path;

a zener diode coupled to a cathode of said diode;

a resistor coupled in series with said zener diode; and, a inductive means, coupled in series with said resistor, for inductively relaying to switch said switching means.

5. The switching circuit of claim 1, wherein said negative voltage criterion is a negative 85-DC Volts and said overvoltage criterion is 140-DC Volts.

6. The switching circuit of claim 1, wherein the at least one probing means coupled to said first path comprises at least a location determination probing means and the at least one probing means coupled to said second path comprises at least a surveying probing means.

7. A switching circuit for use in a subterranean probe for switching between a first mode of operation and a second mode of operation comprising:

(a) means for switching said subterranean probe between said first mode of operation and said second mode of operation;

(b) a first voltage bias network coupled directly to said input path and biased to a negative voltage criterion for controlling said switching means to switch said subterranean probe from said second mode of operation to said first mode of operation;

(c) a second voltage bias network coupled to said input path and biased to an overvoltage criterion for controlling said switching means to switch said subterranean probe from said first mode of operation to said second mode of operation; and, (d) a means for blocking said negative voltage criterion, coupled directly to an output of said switching means and an input of said second path, for allowing said first voltage bias network to fully realize said negative voltage criterion and wherein said blocking means prevents said negative voltage criterion from being absorbed by a voltage regulator network.

8. The switching circuit of claim 7, wherein said first voltage bias network comprises:

a diode coupled directly to said input path;

a resistor coupled in series with said diode; and, an inductive means, coupled in series with said resistor, for inductively relaying to switch said switching means.

9. The switching circuit of claim 7, wherein said second voltage bias network comprises:

a diode coupled to said input path;

a zener diode coupled to a cathode of said diode;

a resistor coupled in series with said zener diode; and, a inductive means, coupled in series with said resistor, for inductively relaying to switch said switching means.

10. The switching circuit of claim 7, wherein said negative voltage criterion is a negative 85-DC Volts and said overvoltage criterion is 140-DC Volts.

11. The switching circuit of claim 7, wherein said first mode of operation is a location determination mode of operation and said second mode of operation is a surveying mode of operation.

12. The switching circuit of claim 11, wherein said location determination mode of operation is performed by a gamma ray device and said surveying mode of operation is performed by a gyro rate device and wherein said voltage regulator network is coupled to the input of said gyro rate device.

13. A method of switching power delivered to a subterranean probe via a single electrical wireline to a first path or a second path, wherein said first path and said second path each have coupled thereto at least one means for probing comprising the steps of:

a) controlling a power supply to supply a negative voltage criterion;

b) blocking said negative voltage criterion;

c) controlling a switch means to switch from said second path to said first path based on said negative voltage criterion;

d) continuously delivering positive DC voltages within a first operating range for operating the at least one probing means in said first path;

e) controlling said power supply to deliver a predetermined overvoltage criterion;

f) switching said power from said first path to said seconds path based on said predetermined overvoltage criterion;

g) controlling said power supply to continuously deliver positive DC voltages in a second operating range for operating the at least one probing coupled to said second path; and, h) repeating steps a–g to alternately operate the at least one probing means coupled to said first path and the at least one probing means coupled to said second path.

14. The method of claim 13, wherein the probing means coupled to said first path is a location determination probing means and the probing coupled to the second path is a surveying probing means.

15. The method of claim 13, wherein said negative voltage criterion is a negative 85-DC Volts and said predetermined overvoltage criterion is 140-DC Volts.

* * * * *